US005921249A

United States Patent [19]

Hampl, Jr.

[11] Patent Number: 5,921,249

[45] Date of Patent: Jul. 13, 1999

[54] HIGH AND LOW POROSITY WRAPPING PAPERS FOR SMOKING ARTICLES

[75] Inventor: Vladimir Hampl, Jr., Roswell, Ga.

[73] Assignee: Schweitzer-Mauduit International, Inc., Alpharetta, Ga.

[21] Appl. No.: 08/892,071

[22] Filed: Jul. 14, 1997

[51] Int. Cl.[6] ..... A24D 1/02; D21H 11/00; D21H 13/00; D21H 15/00

[52] U.S. Cl. ..... 131/365; 162/139; 162/149

[58] Field of Search ..... 131/365; 162/139, 162/149

[56] References Cited

U.S. PATENT DOCUMENTS

| | | | |
|---|---|---|---|
| 3,744,496 | 7/1973 | McCarty et al. . | |
| 4,225,636 | 9/1980 | Cline et al. . | |
| 4,318,959 | 3/1982 | Evans et al. . | |
| 4,411,279 | 10/1983 | Martin et al. . | |
| 4,453,553 | 6/1984 | Cohn . | |
| 4,480,644 | 11/1984 | Luke . | |
| 4,502,282 | 3/1985 | Cogbill et al. . | |
| 4,503,118 | 3/1985 | Murakami et al. . | |
| 4,548,677 | 10/1985 | Schneider et al. . | |
| 4,622,983 | 11/1986 | Mathews et al. . | |
| 4,725,318 | 2/1988 | Minayoshi et al. . | |
| 4,732,748 | 3/1988 | Stewart et al. . | |
| 4,805,644 | 2/1989 | Hampl, Jr. et al. . | |
| 4,881,557 | 11/1989 | Martin | 131/365 |
| 4,924,888 | 5/1990 | Perfetti et al. | 131/336 |
| 4,986,285 | 1/1991 | Radzio et al. . | |
| 4,998,543 | 3/1991 | Goodman et al. . | |
| 5,060,675 | 10/1991 | Milford et al. . | |
| 5,074,321 | 12/1991 | Gentry et al. . | |
| 5,103,844 | 4/1992 | Hayden et al. . | |
| 5,105,835 | 4/1992 | Drewett et al. . | |
| 5,107,864 | 4/1992 | Owens, Jr. . | |

(List continued on next page.)

FOREIGN PATENT DOCUMENTS

| | | |
|---|---|---|
| 135218 | 11/1949 | Australia . |
| 0447094A1 | 9/1991 | European Pat. Off. . |
| 0513985A1 | 11/1992 | European Pat. Off. . |
| 0533423A1 | 3/1993 | European Pat. Off. . |
| 0791688A1 | 8/1997 | European Pat. Off. . |
| 2056890 | 5/1982 | Japan . |
| 66599 | 4/1984 | Japan . |
| 1194298 | 8/1985 | Japan . |
| 299699 | 10/1988 | Japan . |
| 2056698 | 10/1993 | Japan . |
| 2056889 | 10/1993 | Japan . |
| 405279993 | 10/1993 | Japan . |
| 405279994 | 10/1993 | Japan . |
| 249932 | 8/1969 | U.S.S.R. . |
| 249933 | 8/1969 | U.S.S.R. . |
| 2028832 | 3/1980 | United Kingdom . |

OTHER PUBLICATIONS

European Search Report dated Mar. 4, 1998.

European Search Report dated Mar. 5, 1998.

European Search Report dated Mar. 6, 1998.

Abstract Bulletin of the Institute of Paper Chemistry; No. 6; Dec. 1988; Appleton, Wisconsin.

Specialty Minerals, Inc., 1993, p. 151.0, Albafil ® M Slurry.

Specialty Minerals, Inc., 1993, p. 251.1, Albaglos ® Dry.

Specialty Minerals, Inc., 1994, Ultrapaque ™ Slurry.

*Primary Examiner*—Peter Chin
*Assistant Examiner*—Jacqueline A. Ruller
*Attorney, Agent, or Firm*—Dority & Manning, P.A.

[57] ABSTRACT

A method for controlling the permeability of a wrapping paper for smoking articles is disclosed. Specifically, the permeability of the paper is varied by incorporating into the paper a filler material having a particular particle size. In one embodiment, for instance, a filler having a size larger than conventional sized fillers is incorporated into a wrapping paper for significantly increasing the permeability of the wrapping paper. For instance, wrapping papers can be constructed in accordance with the present invention having a permeability of greater than 80 CORESTA units without having to perforate the papers.

9 Claims, 1 Drawing Sheet

U.S. PATENT DOCUMENTS 5,107,866 4/1992 Aronoff et al. .
5,109,876 5/1992 Hayden et al. .
5,143,098 9/1992 Rogers et al. .
5,144,967 9/1992 Cartwright et al. .
5,152,304 10/1992 Bokelman et al. .
5,156,719 10/1992 Passaretti .
5,161,551 11/1992 Sanders et al. .
5,168,884 12/1992 Baldwin et al. .
5,172,708 12/1992 Drewett et al. .
5,215,734 6/1993 Kunesh et al. .
5,227,025 7/1993 Kunesh et al. .
5,228,464 7/1993 Owens, Jr. .
5,253,660 10/1993 Dixit et al. .
5,263,500 11/1993 Baldwin et al. .
5,271,419 12/1993 Arzonico et al. .
5,302,437 4/1994 Idei et al. .
5,307,823 5/1994 Jones et al. .
5,327,916 7/1994 Jones et al. .
5,360,023 11/1994 Blakley et al. .
5,385,158 1/1995 Owens, Jr. .
5,404,890 4/1995 Gentry et al. .
5,417,228 5/1995 Baldwin et al. .
5,450,862 9/1995 Baldwin et al. .
5,450,863 9/1995 Collins et al. .
B1 4,461,311 7/1984 Mathews et al. .

HIGH AND LOW POROSITY WRAPPING PAPERS FOR SMOKING ARTICLES

FIELD OF THE INVENTION

The present invention is generally directed to a method for controlling and adjusting the permeability of wrapping papers for smoking articles. More particularly, the present invention is directed to a method for producing high porosity cigarette papers by incorporating into the wrapping paper a filler having a relatively large particle size. In an alternative embodiment, the present invention is also directed to a method for producing low porosity cigarette wrapping papers using smaller sized filler particles.

BACKGROUND OF THE INVENTION

Smoking articles such as cigarettes are conventionally made by wrapping a column of tobacco in a white wrapping paper. At one end, the smoking article usually includes a filter through which the article is smoked. Filters are attached to smoking articles using a tipping paper which is glued to the white wrapping paper. The wrapping papers and tipping papers used to construct smoking articles are typically made from flax or other cellulosic fibers and contain a filler, such as a calcium or magnesium compound.

Besides being used to hold the cigarette together and to provide the cigarette with an aesthetic appearance, cigarette wrapping papers also contribute to or control many physical properties or characteristics of the cigarette. For instance, cigarette wrapping paper can be used to control the rate at which the cigarette burns, the number of puffs per cigarette, and the tar delivery per puff. Cigarette paper can also be used to limit the amount of smoke that emanates from the lit end of the cigarette when it is left burning. Further, cigarette paper is even used to reduce the tendency of cigarettes to ignite surfaces which come into contact with the cigarette and to cause the cigarette to self extinguish when left unattended.

One of the more important properties of cigarette wrapping paper that is used to control the above-described characteristics of a cigarette is the permeability of the paper. Increasing or decreasing the permeability of a wrapping paper, for instance, varies the burn rate, tar delivery, and puff count of a cigarette made with the paper. Problems have been experienced in the past, however, in the ability to widely vary the permeability of a wrapping paper without adversely effecting other properties of the paper or the overall taste of the cigarette.

One method that is used for controlling the permeability of a wrapping paper is to vary the fiber furnish that is used to make the paper. In general, it is known that if longer fibers are used to construct the wrapping paper, the paper will have a higher permeability.

Another method for controlling the permeability of a wrapping paper is to either increase or decrease the refining of the fiber furnish. Generally speaking, refining the fiber furnish to a greater extent causes a reduction in permeability. More particularly, refining the cellulosic material that is used to make the paper down into smaller sizes creates more surface area, which reduces permeability and leads to better formation.

Another method for altering the permeability of a wrapping paper is to change the amount of filler added to the paper. Increasing or decreasing the filler loading of the paper causes an increase or decrease in permeability respectively. As more filler is added to the paper, the filler tends to interfere with the hydrogen bonding between fibers creating the increase in permeability. Unfortunately, however, altering filler levels in cigarette paper also affects the burn rate of the cigarette independently of permeability, which may be an undesired result.

Other problems are also experienced when filler levels are altered. For instance, as filler content is increased, the strength of the paper is compromised. Conversely, when not enough filler is incorporated into the paper, the opacity of the paper significantly decreases, adversely affecting the appearance of the cigarette. As such, there is increasing pressure to keep filler levels in cigarette paper constant or at least within a preset range.

In some applications, it is desirable to create a wrapping paper that has a high natural permeability. For instance, high permeable wrapping papers are needed in some applications to produce cigarettes that have a fast burn rate and/or a low tar delivery. Some of the methods and processes described above for varying the permeability of a wrapping paper can be used, under some circumstances, to produce papers with high natural permeability characteristics.

In order to increase the permeability of wrapping papers, it is more common, however, to perforate the papers by using a laser or by using an electrostatic charge. Unfortunately, perforating the wrapping paper requires an additional step and thus increases the cost of producing the papers.

Thus, a need exists for a method of naturally adjusting the permeability of a cigarette paper without adversely affecting other characteristics of the paper. A need also exists for a method of altering the permeability of a wrapping paper without having to significantly alter the amount of filler contained within the paper. A need further exists for a method of producing wrapping papers with a high permeability that do not have to be perforated.

SUMMARY OF THE INVENTION

The present invention recognizes and addresses the foregoing disadvantages, and others of prior art constructions and methods.

Accordingly, it is an object of the present invention to provide an improved method of making cigarette wrapping papers.

Another object of the present invention is to provide a method for controlling the permeability of a cigarette wrapper.

It is another object of the present invention to provide a process for producing wrapping papers having a naturally high permeability.

Still another object of the present invention is to provide a process for producing wrapping papers with a high permeability without having to perforate the papers.

It is another object of the present invention to provide a process for increasing the permeability of a paper wrapper by incorporating into the wrapper a filler having a relatively large median particle size, such as a size of at least 2.3 microns.

It is still another object of the present invention to provide a process for increasing the permeability of a paper wrapper without significantly varying the total filler content.

Another object of the present invention, in an alternative embodiment, is to provide a process for producing paper wrappers having a low permeability by incorporating into the wrappers a filler having a relatively small particle size.

In general, the present invention is directed to a process for increasing the permeability of a paper wrapper for a smoking article. The process includes the step of adding to a paper wrapper a filler. The filler has a median particle size of at least 2.3 microns and is added to the paper in an amount sufficient such that the paper has a permeability of at least 60 CORESTA units, and more particularly at least 80 CORESTA units. For instance, in one embodiment of the present invention, the paper wrapper can have a permeability of from about 100 CORESTA units to about 200 CORESTA units.

As described above, the permeability of the paper wrapper is increased by adding a filler that has a median particle size of at least 2.3 microns, and particularly from about 2.3 microns to about 12 microns. In one embodiment, the median particle size of the filler can be from about 2.3 microns to about 9 microns and in one preferred embodiment of the present invention, the median particle size of the filler is from about 3 microns to about 4 microns. The filler can be added to the paper so that the paper has a total filler level of from about 20% by weight to about 45% by weight, and particularly from about 30% by weight to about 40% by weight. The filler can be various inorganic compounds, such as calcium carbonate.

Paper wrappers made in accordance with the present invention can have a basis weight of from about 18 gsm to about 40 gsm, and particularly from about 22 gsm to about 30 gsm. A burn control additive can be added to the paper if desired. The burn control additive can be an alkali metal salt, such as sodium or potassium citrate, or an acidic salt, such as sodium or potassium phosphate. The burn control additive can be added in an amount from about 0.3% to about 16% by weight.

These and other objects of the present invention are also achieved by providing a naturally high permeable paper wrapper for a smoking article. The paper wrapper includes a base web made from pulp fibers. In accordance with the present invention, a filler is incorporated into the base web that has a median particle size of at least about 2.3 microns. The filler is present in the base web in an amount up to about 45% by weight, which produces a paper wrapper having a permeability of at least 80 CORESTA units.

Other features, objects and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figure, in which:

The FIGURE is a graphical illustration of the results obtained in Example 1.

DETAILED DESCRIPTION OF PREFERRED EMBODIMENTS

Figure 1:
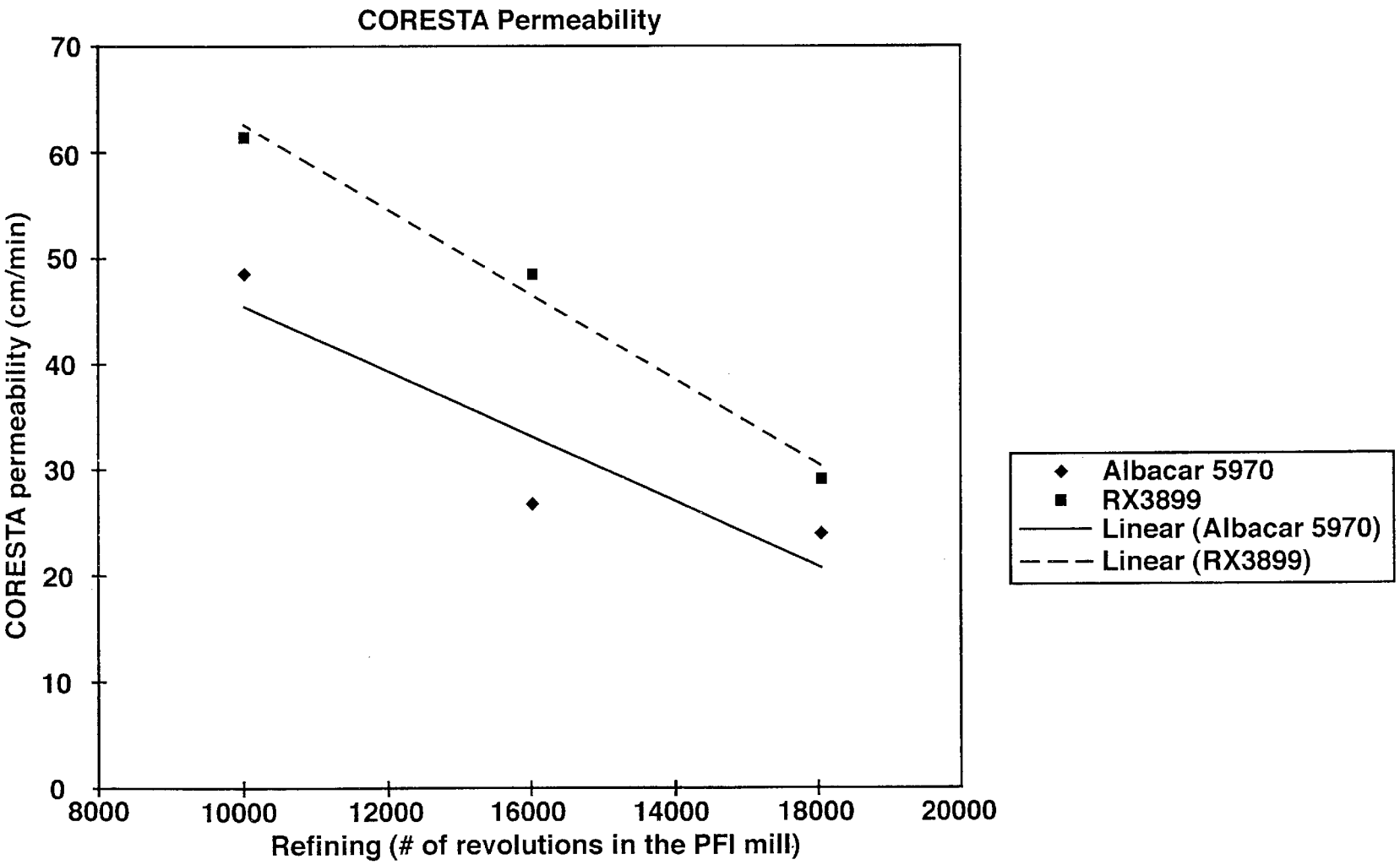

It is to be understood by one of ordinary skill in the art that the present discussion is a description of exemplary embodiments only, and is not intended as limiting the broader aspects of the present invention, which broader aspects are embodied in the exemplary construction.

The present invention is generally directed to a method for controlling the permeability of a paper wrapper for a cigarette. The permeability of the wrapper is controlled by incorporating into the wrapper a filler having a particular median particle size. More particularly, according to the present invention, the permeability can be controlled exclusively as a function of filler particle size regardless of the total amount of filler contained in the paper. In other words, the permeability of the paper can be controlled and adjusted without significantly increasing or decreasing the total filler content beyond conventional levels.

For example, in one preferred embodiment of the present invention, naturally high permeable wrapping papers are produced by incorporating into the paper a filler having a relatively large particle size. Paper wrappers having a high permeability are used and desired when constructing smoking articles, such as cigarettes, that have a fast burn rate and/or a low tar delivery. In the past, high permeable paper wrappers have been typically produced by perforating the paper. Unfortunately, perforating the wrapping paper adds to the cost of producing the paper.

The process of the present invention, however, can produce naturally high permeable cigarette wrapping papers which reduce the need to perforate the paper. Further, the process of the present invention can be used to increase the permeability of a paper wrapper without significantly altering any of the other properties and characteristics of the paper. In fact, paper wrappers having a high permeability can be produced without having to significantly increase or decrease conventional filler levels in the paper.

According to the present invention, the naturally high permeable wrapping papers are produced by incorporating into the papers a filler having a median particle size that is greater than fillers that have been conventionally used in cigarette paper. For instance, the filler can have a median particle size of at least 2.3 microns, and more particularly from about 2.3 microns to about 12 microns. In most applications, the filler can have a median particle size of from about 2.3 microns to about 9 microns and, in one preferred embodiment, has a median particle size of from about 2.3 microns to about 4.0 microns. As used herein, median particle size refers to the size of a filler as measured and determined by a sedimentation procedure using, for instance, a sedigraph.

By incorporating a filler having a particle size within the above described range, a high permeability paper can be produced. For instance, the paper can have a permeability of greater than 60 CORESTA units, and more particularly greater than 80 CORESTA units. For instance, a paper wrapper can be produced according to the present invention having a permeability of from about 100 CORESTA units to about 200 CORESTA units. Of particular advantage, such high permeability levels can be obtained without having to perforate the paper.

The amount of filler added to the paper generally depends upon the desired permeability and the particle size of the filler used. Of particular advantage, however, the above-described permeability levels can be obtained without substantially increasing the filler level in the paper from conventional levels. Thus, for most applications, the total filler level in the paper can be from about 20% by weight to about 45% be weight, and particularly from about 30% by weight to about 40% by weight.

In making paper wrappers in accordance with the present invention, a single larger sized filler can be added to the paper. Alternatively, however, mixtures of different sized fillers may be used. For instance, mixtures of different larger sized fillers may be added to the paper or a larger sized filler may be mixed with a filler having a smaller, conventional size. In one embodiment of the present invention, a filler having a particle size of from about 2.5 microns to about 4 microns is added to the paper in an amount of about 35% by weight in order to produce a paper having a permeability of greater than 80 CORESTA units.

It is believed that any filler material may be used in the process of the present invention. Such fillers may include, for instance, calcium carbonate, titanium dioxide, magnesium carbonate, magnesium oxides and the like. It is also within the scope of the present invention to mix different kinds of filler materials in order to get a broader range of particle sizes and morphologies. For instance, a calcium carbonate filler may be mixed with a magnesium oxide filler. In one preferred embodiment of the present invention, a precipitated calcium carbonate filler having a median particle size of greater than 2.3 microns is used.

When fillers are added to a paper, the filler particles interfere with the fiber-to-fiber bonding occurring between the cellulosic fibers during formation of the paper. It is believed that the filler particles wedge themselves between adjacent fibers creating a void space and hence an increase in the porosity of the paper. It has been discovered through the present invention, that the degree to which the fiber-to-fiber bonding is disrupted by the filler depends not only on the number of particles, but also on the morphology of the particles. In particular, it is believed that as the size of the filler particles increases, the fibers are pried apart farther creating larger pores in the paper. It has also been unexpectedly discovered that as larger sized filler particles are used, the increase in permeability is more than linear.

In incorporating the larger sized filler into a paper wrapper in accordance with the present invention, in one embodiment, the filler can be combined with water to form a filler slurry. The slurry can then be added to a suspension of cellulosic fibers when forming the paper. For instance, the fiber suspension can be formed from a fiber furnish that has been cooked in a digester, washed, bleached and refined. To form the paper wrapper, the resulting slurry and fiber suspension mixture can be spread out onto a screen or a set of screens and dried.

The basis weight of wrapping paper made in accordance with the present invention is generally not critical. In most applications, however, the paper should have a basis weight of from about 18 gsm to about 40 gsm, and more particularly from about 22 gsm to about 30 gsm. In one preferred embodiment, a wrapping paper is produced that has a basis weight of 28 gsm.

The wrapping paper of the present invention may also be treated with a burn control additive. Such burn control additives can include, for instance, alkali metal salts, such as potassium or sodium citrate, or acidic salts, such as sodium or potassium phosphates. Different types of burn control additives can also be mixed and applied to the paper. The burn control additive can be added to the paper in an amount from about 0.3% to about 16% by weight, and in one application from about 0.3% to about 3% by weight.

The present invention may be better understood with reference to the following examples.

EXAMPLE NO. 1

In order to demonstrate the present invention, various handsheets were made. One set of sheets contained ALBACAR 5970 calcium carbonate filler having a median particle size of 1.9 microns. ALBACAR 5970, which is marketed by Specialty Minerals, Inc. of Adams, Mass., has traditionally been used in the past as a filler in wrapping papers for smoking articles.

In the second set of samples, the sheets contained RX3899 calcium carbonate filler also obtained from Specialty Minerals, Inc. RX3899 filler has a median particle size of 2.7 microns.

All of the handsheets that were constructed had a basis weight of 28 gsm and a filler loading of 30% by weight.

The amount the fiber furnish was refined, however, was varied in each set of samples. Specifically, handsheets from both sets of samples were made with fiber flax furnishes that went through 10,000, 14,000 and 18,000 revolutions in a PFI mill. The results are illustrated in the figure.

As generally known in the art, as refinement of the furnish increases, permeability decreases as is shown on the accompanying figure. The figure, however, also shows that the permeability of the handsheets made from the larger sized filler was greater than the handsheets made from the smaller sized filler. Further, permeability increased more rapidly with respect to the handsheets made from the larger sized filler as the amount of refinement of the fiber furnish was decreased. Specifically, the permeability of the handsheets using the larger sized filler increased by more than 25%.

EXAMPLE NO. 2

In this example, a wrapping paper made using ALBACAR 5970 filler having a median particle size of 1.9 microns was compared with paper wrappers made using ADX 7014 filler having a median particle size of 3.5 microns. Both fillers were obtained from Specialty Minerals, Inc. In this example, the wrapping papers were made using a paper machine. The fillers were made from precipitated calcium carbonate.

Three (3) different wrapping papers were made. All three papers had a basis weight of 28 gsm. The first paper made contained ALBACAR 5970 in an amount of 26% by weight. The remaining two paper wrappers contained ADX 7014 filler in an amount of 25% by weight and 33% by weight respectively. Once the paper wrappers were constructed, they were tested for permeability. The following results were obtained:

| Sample No. | 1 | 2 | 3 |
|---|---|---|---|
| Basis Weight (g/m$^2$) | 28 | 28 | 28 |
| ALBACAR 5970 (%) | 26 | 0 | 0 |
| ADX 7014 (%) | 0 | 25 | 33 |
| Citrate (%) | 0.9 | 0.9 | 0.95 |
| CORESTA | 72 | 83 | 165 |
| Brightness (%) | 88.5 | 88.5 | 88.5 |
| Opacity (%) | 76 | 74 | 76 |
| Machine Direction Tensile Strength (g/29 mm) | 3000 | 3000 | 2300 |

As shown in the table, paper wrappers made using ADX 7014 filler had a higher permeability than the paper wrapper made from conventional ALBACAR 5970 filler. Of particular significance, in Example No. 3, the filler level in the paper was only increased by 7% but the permeability of the paper more than doubled. Because the filler level was increased, the strength of the paper decreased slightly.

Besides using larger sized fillers to increase the permeability of wrapping papers, the present invention is also directed to using smaller sized fillers to construct low permeable papers. Such low permeable papers may be useful in the reduction of sidestream smoke emanating from a lit cigarette made with the paper. For instance, it is believed that wrapping papers having a permeability of less than 7 CORESTA units can be made by incorporating into the wrapper a filler having a median particle size of less than about 0.1 microns, such as from about 0.1 microns to about 0.01 microns. For instance, in one embodiment, a calcium carbonate filler having a median particle size of about 0.07 microns can be used to construct a wrapping paper having a permeability of less than 5 CORESTA units, and particularly from about 3 to 4 CORESTA units. Such wrappers may be constructed having the same filler levels and other characteristics and properties as mentioned above. The papers may have a greater basis weight, however, such as up to about 60 gsm.

These and other modifications and variations to the present invention may be practiced by those of ordinary skill in the art, without departing from the spirit and scope of the present invention, which is more particularly set forth in the appended claims. In addition it should be understood that aspects of the various embodiments may be interchanged both in whole or in part. Furthermore those of ordinary skill in the art will appreciate that the foregoing description is by way of example only, and is not intended to limit the invention so further described in such appended claims.

What is claimed is:

1. A naturally high permeable paper wrapper for a smoking article comprising:

a base web made from pulp fibers;

a filler incorporated into said base web, said filler having a median particle size of from at least about 2.3 microns to about 9 microns, said base web having a total filler loading in an amount from about 20% to about 45% by weight and a basis weight of from about 18 gsm to about 40 gsm; and wherein said paper wrapper has a natural permeability of from about 80 CORESTA units to about 200 CORESTA units.

2. A paper wrapper as defined in claim 1, wherein said filler has a median particle size of from about 3 microns to about 8 microns.

3. A paper wrapper as defined in claim 1, wherein said base web has a total filler loading in an amount from about 20% to about 40% by weight.

4. A paper wrapper as defined in claim 3, wherein said paper wrapper has a basis weight of from about 22 gsm to about 32 gsm.

5. A paper wrapper as defined in claim 1, wherein said filler comprises calcium carbonate.

6. A paper wrapper as defined in claim 1, wherein said paper wrapper has a natural permeability of from about 100 CORESTA units to about 200 CORESTA units.

7. A high permeable paper wrapper for a smoking article comprising:

a base web made from pulp fibers;

a filler incorporated into said base web, said filler having a median particle size of from about 2.3 microns to about 9 microns, said base web having a total filler loading in an amount from about 20% to about 40% by weight;

a burn control additive applied to said base web, said burn control additive being added in an amount from about 0.3% to about 16% by weight; and wherein said paper wrapper has a basis weight of from about 22 gsm to about 30 gsm and has a natural permeability of at least 80 CORESTA units to about 200 CORESTA units.

8. A paper wrapper as defined in claim 7, wherein said filler comprises calcium carbonate.

9. A paper wrapper as defined in claim 8, wherein said base web has a total filler loading in an amount of from about 20% to about 40% by weight and wherein said filler has a median particle size of from about 2.3 microns to about 4.0 microns.

* * * * *